US005169149A

United States Patent [19]

Pepa

[11] Patent Number: 5,169,149

[45] Date of Patent: Dec. 8, 1992

[54] PUZZLE CONSISTING OF CHAINS FITTED SIDE BY SIDE

[75] Inventor: Silvia Pepa, Camerano, Italy

[73] Assignee: Marplay - S.r.l., Camerano, Italy

[21] Appl. No.: 840,874

[22] Filed: Feb. 25, 1992

[51] Int. Cl.[5] ..... A63F 9/08; F16G 13/00

[52] U.S. Cl. ..... 273/156; 273/155; 59/80

[58] Field of Search ..... 273/153 R, 155, 156, 273/159; 446/124; 59/80, 82, 93

[56] References Cited

U.S. PATENT DOCUMENTS 2,169,265 8/1939 Mantz ..... 59/80

2,480,015 8/1949 Goode ..... 59/80

3,667,153 6/1972 Christiansen ..... 446/124

5,069,028 12/1991 Fornaini ..... 59/80

*Primary Examiner*—V. Millin

*Assistant Examiner*—Steven B. Wong

*Attorney, Agent, or Firm*—Leonard Bloom

[57] ABSTRACT

This invention concerns a "puzzle" whose pieces consist of a plastic colored bracket which hooks to identical brackets to form a chain, which is then placed adjacent to other chains of the same shape to form a screen on which any drawing representing the result of a pre-established assembly order of the various multi-colored brackets can be reproduced.

1 Claim, 1 Drawing Sheet

TAV. 1-1

PUZZLE CONSISTING OF CHAINS FITTED SIDE BY SIDE

Figure 1:
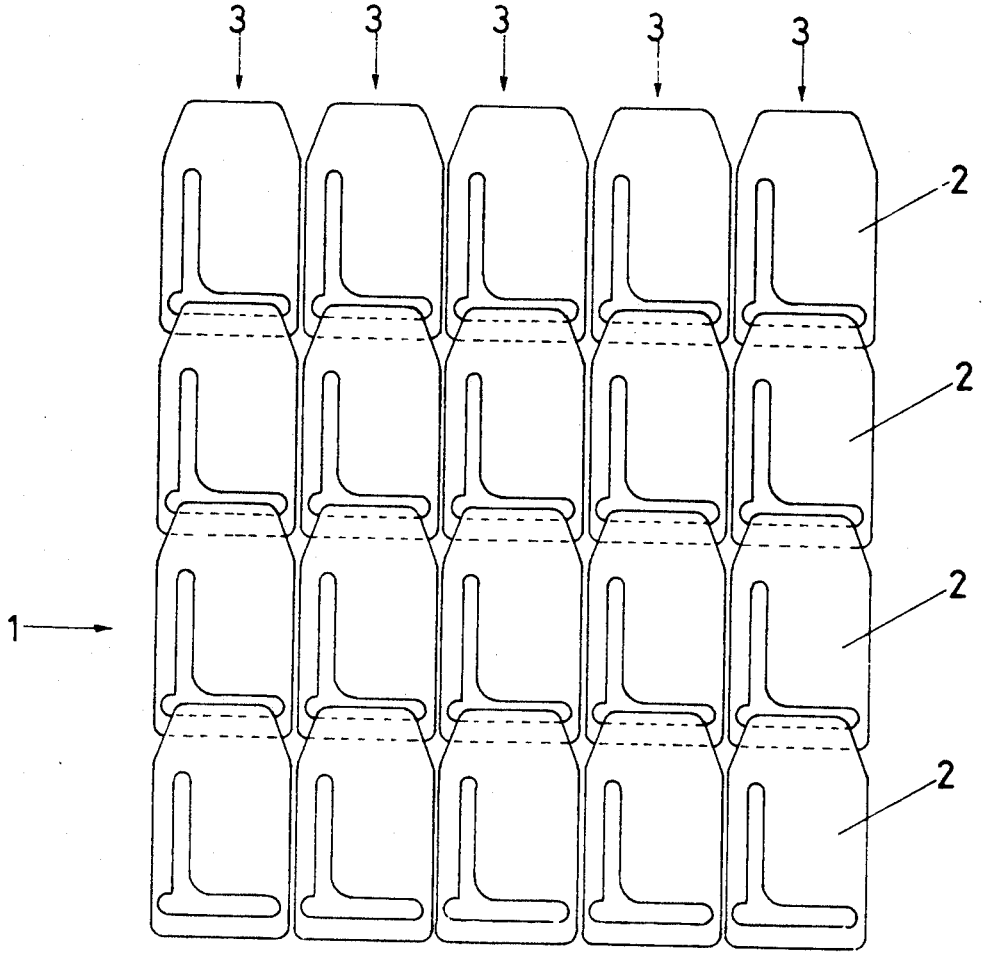

This patent application concerns a puzzle consisting of chains fitted side by side, which are in turn formed by modular linked brackets.

The word "puzzle" is of English origin but is today also used in Italian to describe those games which consist of having to rearrange and join the scattered pieces of an object divided into different shapes.

In the majority of cases, this involves joining and wedging together irregular pieces obtained by breaking up a piece of cardboard, wood or plastic on which the drawing has been printed.

In other cases, the player must reconstruct a figure by fitting together cube shaped modules on whose six sides fragments of six different figures are reproduced. The "puzzle" according to the invention is an absolute novelty in terms of the structure, since each piece consists of a moulded plastic bracket, which can easily be linked without any means of fixing to other identical brackets in order to form a chain, which is then fitted next to other chains of the same shape to form a screen on which a drawing representing the pre-established assembly order of the different multi-coloured brackets can be reproduced.

In other words, the player will have many different coloured brackets jumbled together which he or she must hook to form the chains and then place the chains side by side to reproduce the drawing in question.

Each bracket is moulded in a single piece of plastic. From a side view, its shape is that of an upside down "U" consisting of two identical rectangular opposing tabs placed side by side, having a through "L" shaped slot which makes it possible to hook each bracket into the one above in order to produce a chain of these brackets. These brackets are as easy to unhook as they are to hook. In this way the player can easily and quickly change and correct the arrangement of the brackets, when this is incorrect in order to recompose the drawing in question.

Figure 2:
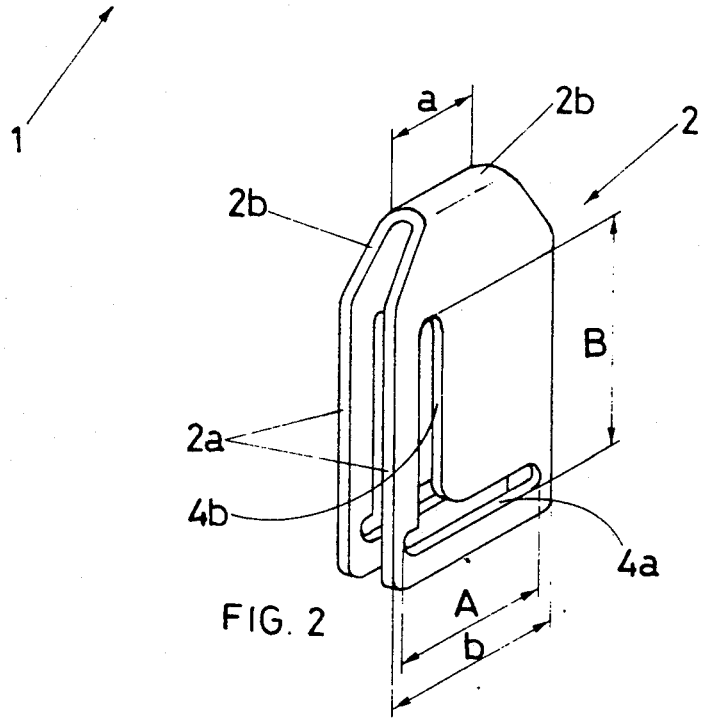

For major clarity the description of the invention continues with reference to the enclosed tables, which are intended for purposes of illustration and not in a limiting sense, in which:

FIG. 1 illustrates the "puzzle" according to the invention;

FIG. 2 is an axonometric view of the brackets making up the composition of the "puzzle" according to the invention. With reference to FIG. 1, the "puzzle" (1) in question involves the use of numerous brackets (2) whose shape permits them to be linked quickly to two identical brackets without external fixing devices of any kind, in order to make flat chains (3) in which each bracket is fitted and hangs from the one above.

The game obviously consists of making up chains (3) with the jumbled brackets (2). Each chain will consist of various brackets (2) linked in the correct order. These chains (3) will in turn be placed side by side to reproduce the drawing in question.

With reference to FIG. 2, it is pointed out that each bracket (2) is a single piece of moulded plastic consisting of two identical rectangular flat tabs (2*a*), placed side by side and joined by a section at the end (2*b*) which is folded to form a semi-circular arch, whose side profile is that of an upside down "U".

Each tab (2*a*) has an "L" shaped through slot obtained by the intersection at a right angle of a horizontal slot (4*a*) and a vertical slot (4*b*) which are close and parallel to the base and to the left side of the tab (2*a*), respectively.

The width of the above coupling section (2*b*) tapers to the minimum value indicated with letter (a) at the upper edge of the bracket (2).

In order to permit fast and easy hooking and unhooking of the brackets (2), the minimum width (a) of section (2*b*) is slightly less than the length (A) of the horizontal slot (4*a*), just as the length (B) of the vertical slot (4*b*) must be greater than the width (b) of the base of the tab (2*a*). The two brackets (2) are hooked together by fitting one tab (2*a*) of the first bracket through both vertical slots (4*b*) of the second bracket; once this has been done, the first bracket is rotated to 90° so as to slide its section (2*b*) into the horizontal slots (4*a*) of the second bracket (2), which, once the assembly has been completed, will be perfectly aligned to the underlying first bracket (2) which hangs from the horizontal slots (4*a*) of the second bracket.

By repeating this operation with the other brackets (2), which are used like the rings of a chain, a ribbon-like structure is formed in different lengths, as necessary. Attention is drawn to the importance of the rectangular shape chosen for the profile of each bracket (2), since this shape is extremely important for the piece of the mosaic which must be as compact and uniform as possible, and whose spaces must obviously be as small as possible in order to provide a good graphical definition of the multi-coloured drawing reproduced.

Finally, attention is also drawn to the choice of the "L" shaped profile of the slot on the tabs (2*a*) of each bracket (2): the use of this profile in fact is the result of careful research work carried out to find the most suitable shape for quickly and easily hooking and unhooking the brackets (2).

I claim:

1. A puzzle consisting of a plurality of flat chains placed side by side, said chains consisting of a plurality of flat multi-coloured brackets, each bracket moulded from a single piece of plastic and characterized in that each bracket (2) consists of two identical flat rectangular tabs (2*a*), placed opposingly and connected by a folded end section (2*b*) forming a semi-circular arch, which tapers to a minimum width (a) at the top end of the bracket (2) and wherein said tabs (2*a*) have an "L" shaped through slot obtained by an intersection at a right angle of a horizontal slot (4*a*) proximal and parallel to a base of the tab (2*a*) and a vertical slot (4*b*), proximal and parallel to a left side of the tab (2*a*); the minimum width (a) of the section (2*b*) is less than the length (A) of the horizontal slot (4*b*) and the length (B) of the vertical slot (4*b*) is greater than the base width (b) of tab (2*a*).

* * * * *